US007438285B2

(12) United States Patent
Maritan et al.

(10) Patent No.: US 7,438,285 B2
(45) Date of Patent: Oct. 21, 2008

(54) REFRIGERATOR WITH CARBONATED WATER DISTRIBUTOR

(75) Inventors: Marco Maritan, Viggiu' (IT); Stefano Tavolazzi, Verbania-Intra (IT)

(73) Assignee: Whirlpool Corporation, Benton Harbor, MI (US)

( * ) Notice: Subject to any disclaimer, the term of this patent is extended or adjusted under 35 U.S.C. 154(b) by 369 days.

(21) Appl. No.: 10/516,467

(22) PCT Filed: Apr. 10, 2003

(86) PCT No.: PCT/EP03/03723

§ 371 (c)(1),
(2), (4) Date: Oct. 24, 2005

(87) PCT Pub. No.: WO03/098136

PCT Pub. Date: Nov. 27, 2003

(65) Prior Publication Data

US 2006/0086136 A1 Apr. 27, 2006

(30) Foreign Application Priority Data

May 16, 2002 (IT) ..... MI2002A1045

(51) Int. Cl.
*B01F 3/04* (2006.01)

(52) U.S. Cl. ..... 261/64.1; 261/64.3; 261/65; 261/66; 261/DIG. 7

(58) Field of Classification Search ..... 261/64.1, 261/64.3, 64.5, 65, 66, 74, 119.1, DIG. 7
See application file for complete search history.

(56) References Cited

U.S. PATENT DOCUMENTS

| | | | | | |
|---|---|---|---|---|---|
| 3,226,099 | A * | 12/1965 | Black et al. | 261/35 |
| 3,618,905 | A | 11/1971 | Primus | |
| 4,514,994 | A * | 5/1985 | Mabb | 62/389 |
| 4,708,266 | A * | 11/1987 | Rudick | 222/105 |
| 4,850,269 | A * | 7/1989 | Hancock et al. | 99/323.1 |
| 4,866,949 | A * | 9/1989 | Rudick | 62/307 |
| 4,940,164 | A | 7/1990 | Hancock et al. | |
| 4,970,871 | A * | 11/1990 | Rudick | 62/187 |
| 5,000,351 | A * | 3/1991 | Rudick | 222/105 |
| 5,115,942 | A * | 5/1992 | Merrill et al. | 222/1 |
| 5,918,773 | A * | 7/1999 | Donovan et al. | 222/146.6 |
| 6,751,525 | B1 * | 6/2004 | Crisp, III | 700/241 |
| 6,766,656 | B1 * | 7/2004 | Crisp et al. | 62/389 |
| 7,083,071 | B1 * | 8/2006 | Crisp et al. | 222/399 |
| 2004/0124548 | A1 * | 7/2004 | Rona et al. | 261/64.3 |

FOREIGN PATENT DOCUMENTS

| | | |
|---|---|---|
| EP | 369419 | 5/1990 |
| WO | WO02/02455 | 1/2002 |

* cited by examiner

*Primary Examiner*—Scott Bushey
(74) *Attorney, Agent, or Firm*—Kirk Goodwin; Michael D. LaFrenz

(57) ABSTRACT

A refrigerator incorporating in its door a water dispenser within a compartment present on the outside of the door, the dispenser being connected to a water container of given capacity carried by the door and provided to enable the contained water to be carbonated via a connection to a cylinder that contains the carbonating gas and is also disposed in the door.

12 Claims, 2 Drawing Sheets

REFRIGERATOR WITH CARBONATED WATER DISTRIBUTOR

BACKGROUND OF THE INVENTION

The present invention relates to a refrigerator incorporating in its door a water dispenser, the water being withdrawn by the user at a compartment present on the outside of the door.

DESCRIPTION OF THE RELATED ART

In traditional refrigerators, there is no provision for dispensing carbonated water in addition to still water.

SUMMARY OF THE INVENTION

The present invention relates to a refrigerator configured to dispense both carbonated water and still water.

Another embodiment of the present invention concerns a refrigerator that enables a given quantity of water to be carbonated in situ, i.e. within the door.

Furthermore, an additional embodiment of the present invention includes a refrigerator of the indicated type in which the water can be carbonated by technical processes and expedients which are simple and hence economical even though reliable.

These embodiments, in addition to others that will be apparent from the ensuing detailed description, are realized by a refrigerator according to the technical teachings of the accompanying claims.

DETAILED DESCRIPTION

Figure 1:
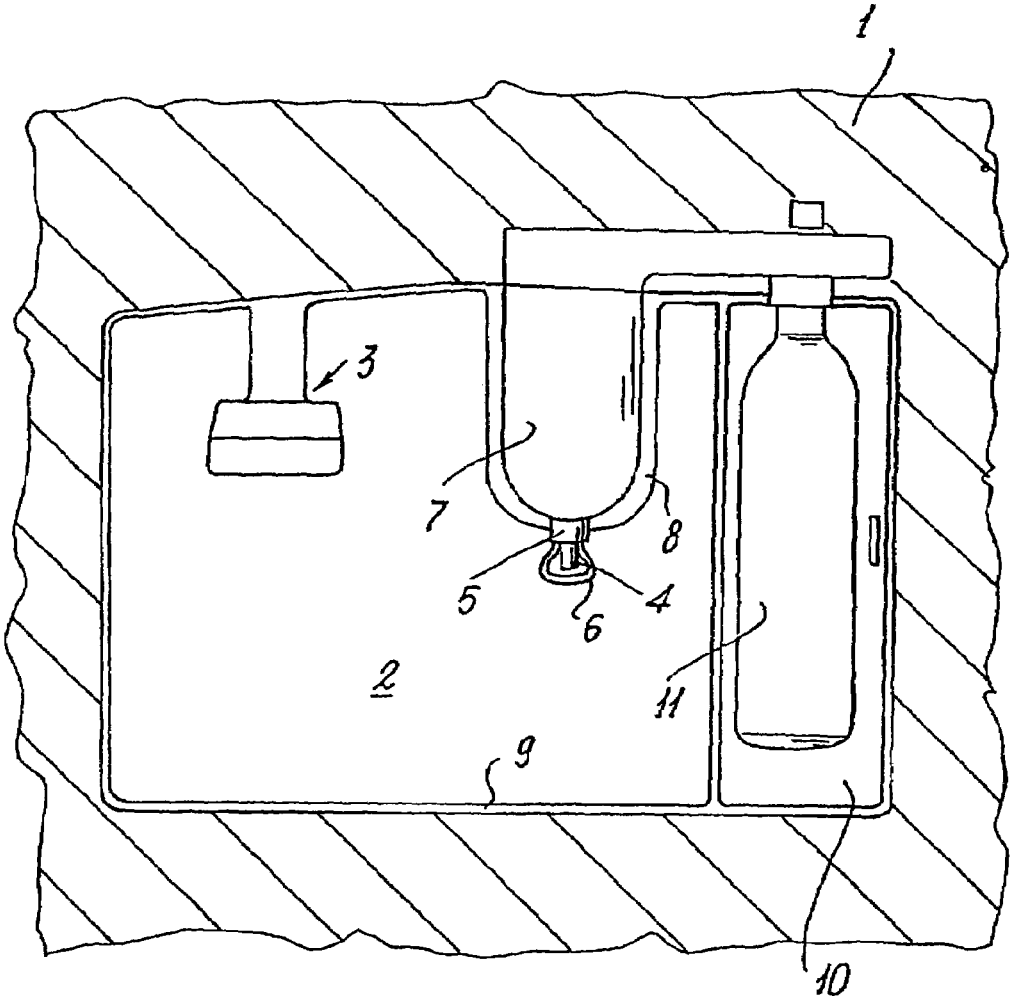
FIG. 1 is a schematic partial view of a refrigerator door shown in vertical section through the compartment from which the water present in the door is withdrawn.

FIG. 1 depicts a refrigerator door 1, shown partially in vertical section. In the door there is provided a conventional compartment 2 open towards the outside and usable by the user to fill any container, for example a glass, with ice via a conventional dispenser for that purpose, or with cooled water which, according to the invention can be carbonated or still.

The water is dispensed via a nozzle 4 intercepted by a valve 5 conventionally operated by the user who for this purpose acts on a dispensing handgrip operationally connected to the valve.

The nozzle 4, valve 5 and handgrip 6 form a dispenser and are situated at the lower end of a water container, of given capacity, 7 mounted in a tubular seat 8, which extends into the compartment 2 and forms part of the lining of this compartment 2.

Figure 2:
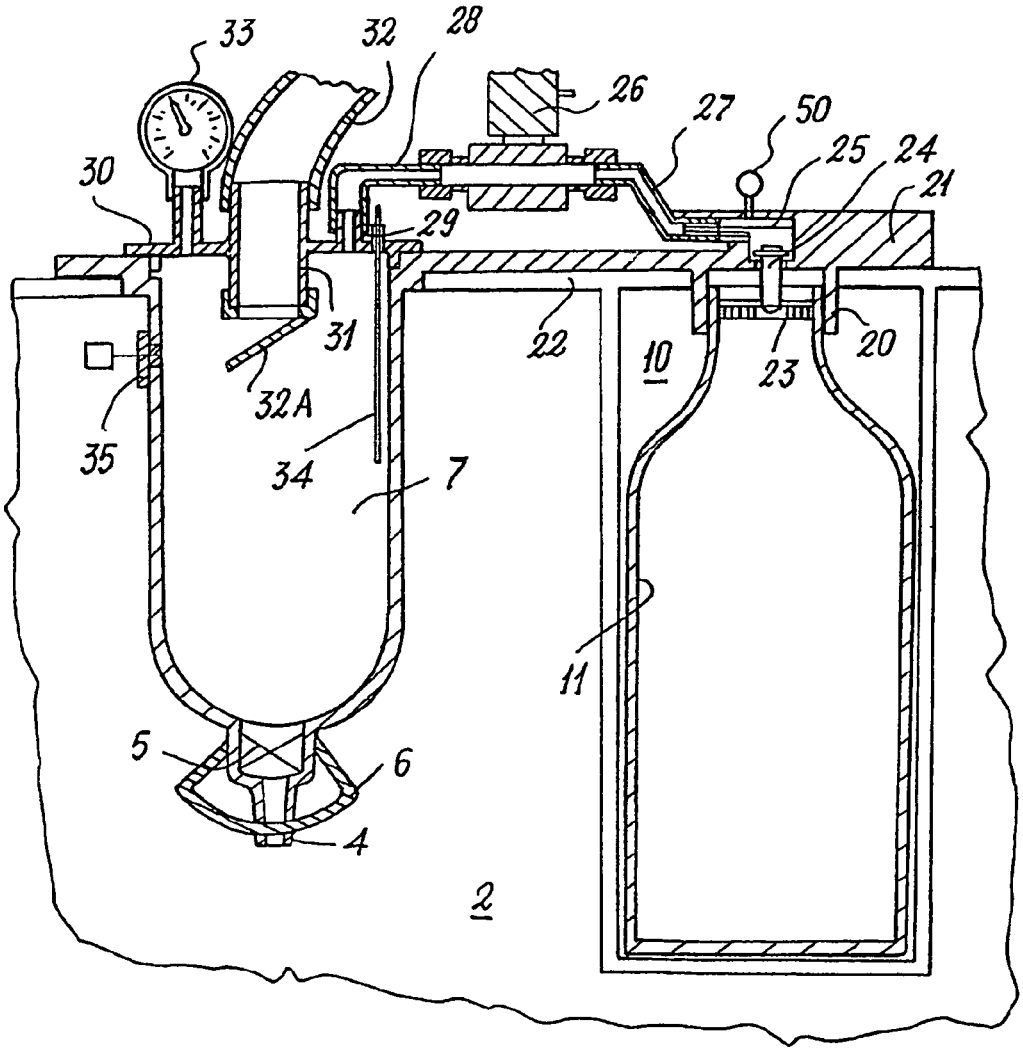
FIG. 2 is a schematic view of the components involved in the dispensing of the water.

A chamber 10 of the compartment 2 (compartment to which access can be gained from the outside or from the inside of the door and which is closed by a shutter, not shown) removably houses a $CO_2$ cylinder, indicated by 11 and connectable to the container 7 to carbonate the water quantity contained therein, as described hereinafter with particular reference to FIG. 2.

This latter figure shows a more detailed construction of that already described. In FIG. 2 equal or corresponding parts carry the same reference numerals as already used.

The $CO_2$ cylinder is screwed or tightly pressed into a port 20 forming part of a support piece 21 fixed to the roof 22 of the compartment 2. The cylinder 11 is closed by a seal 23 that is perforated by a needle valve 24 mounted in the support piece 21 and located at the entry to a conduit 25 that extends into the support piece 21 and to which a solenoid valve 26 is connected via a pipe 27. The exit of the solenoid valve 21 is connected via a pipe 28 to an inlet port 29 present in a cover 30 fixed in any known manner to the support piece 21.

The cover 30 forms the seal for the water container 7 (which defines the carbonation environment) that, in this example, is integral with the support piece 21. The cover presents a nozzle 31 that passes through the cover, and at one end is connected to a conduit 32 for feeding water, for example tap water. At its other end the nozzle 31 is provided with a controlled valve 32A. A pressure gauge 33 can also be connected to the cover. The cover 30 also carries: a conventional level sensor 34 which extends into the container 7, and a safety (overpressure) valve 35 which acts on an electrical microswitch controlling a carbonated water indicator lamp (not visible) indicating that carbonation has taken place. Although not shown, there is also provided a pushbutton, which by operating (in the sense of opening) the solenoid valve 26 connects the container 7 filled with water to the cylinder 11 for carbonating this water.

Initially the container is empty. The level sensor 34 senses this situation and causes water to enter the container through the electrically operated valve 32A or alternatively through a solenoid valve, not shown, positioned in the conduit 32. The cooled still water is hence fed into the container 7. When a predetermined water level is reached, the level sensor 34 halts the feed of water (by acting on the valve 32A or on the alternative valve) and lights an indicator lamp that warns the user that the desired water level has been attained. The still water can however be withdrawn continuously even if the desired level has not been reached and the relative indicator lamp is not lit. Withdrawal is achieved in conventional manner by acting on the nozzle 4, valve 5 and handgrip 6.

When the level indicator lamp is lit, the user can, if desired, initiate the carbonation phase by pressing a pushbutton (not shown) which activates the solenoid valve 26, enabling the $CO_2$ to flow from the cylinder 11 to the container 7 and to carbonate the water contained therein.

As already stated, the container 7 presents a safety and overpressure valve 35 provided with a electrical switch which when the required pressure has been attained in the container 7 closes the solenoid valve 26 and lights the indicator lamp to advise the user that the now carbonated water is ready to be drawn off.

In the case of operating anomalies, for example overpressure, the safety valve 35 opens to discharge the excess $CO_2$ into the atmosphere and at the same time closes the solenoid valve 26 to prevent the danger of explosion of the container 7.

The following advantages derive from the invention: the user no longer has to physically purchase large quantities of still or carbonated water, transport it and then store it in the home; this signifies a saving of time and fatigue; in addition empty bottles do not have to be retained for their recycling, there is less refuse and from an economical viewpoint there is a saving in the cost of the water, in addition to having it always available when required by the user.

The reference numeral 50 indicates a pressure sensor (pressure switch) that measures the pressure of the cylinder 11 and acts on an indicator lamp (not shown) to warn the user that the cylinder is empty.

The invention claimed is:

1. A refrigerator comprising:

a door having a water dispenser within a compartment present on an outside of the door;

a water container of given capacity;

a cylinder containing a carbonating gas, said cylinder being in selective communication with the water container via a connection, wherein the water dispenser is connected to the water container to selectively dispense still water from the water container through the water dispenser and water in the water container is adapted to be carbonated via the connection to the cylinder containing the carbonating gas to selectively dispense carbonated water through the water dispenser, and wherein the cylinder and the water container are connected together via a solenoid valve; and a water level sensor which, when a given water level has been reached within the water container, activates a signal which indicates to the user that the water can now be carbonated by operating the solenoid valve.

2. The refrigerator of claim 1, wherein the cylinder is disposed in a chamber of the door, the chamber being accessible from inside or from outside of the door.

3. The refrigerator of claim 1, wherein the water container is adapted to be connected to a domestic water supply or to a cooled source of water via a controlled valve.

4. The refrigerator of claim 1, wherein the connection between the cylinder and water container further comprises, upstream of the solenoid valve, a needle valve cooperating with the cylinder.

5. A refrigerator comprising:

a door having a water dispenser within a compartment present on an outside of the door;

a water container of given capacity; and a cylinder containing a carbonating gas in selective communication with the water container via a connection, wherein the water dispenser is connected to the water container to selectively dispense still water from the water container through the water dispenser and the water in the water container is adapted to be carbonated via the connection to the cylinder containing the carbonating gas to selectively dispense carbonated water through the water dispenser, wherein the water container is provided with a safety valve to prevent excess pressure and the safety valve operates on an electrical switch to interrupt, at a predetermined carbonation pressure, the connection between the cylinder and the water container, and wherein the switch activates an indicator advising the user that the water is carbonated and ready to be drawn off.

6. The refrigerator of claim 5, wherein an indicator lamp is provided to signify when the cylinder is empty.

7. The refrigerator of claim 5, wherein the cylinder is disposed in a chamber of the door, the chamber being accessible from inside or from outside of the door.

8. A refrigerator comprising:

a door having a water dispenser within a compartment present on an outside of the door;

a water container of given capacity, wherein the water dispenser is connected to the water container to selectively dispense still water from the water container through the water dispenser;

a cylinder containing a carbonating gas in selective communication with the water container via a connection;

means for selectively carbonating water in the water container, via the connection to the cylinder containing the carbonating gas, to dispense carbonated water through the water dispenser, wherein the means for selectively carbonating water in the water container includes a solenoid valve arranged along the connection; and a water level sensor which, when a given water level has been reached within the water container, activates a signal which indicates to the user that the water can now be carbonated.

9. The refrigerator of claim 8, wherein the water container is adapted to be connected to a domestic water supply or to a cooled source of water via a controlled valve.

10. The refrigerator of claim 8, wherein the connection between the cylinder and water container further comprises, upstream of the solenoid valve, a needle valve cooperating with the cylinder.

11. A refrigerator comprising:

a door having a water dispenser within a compartment present on an outside of the door;

a water container of given capacity, wherein the water dispenser is connected to the water container to selectively dispense still water from the water container through the water dispenser;

a cylinder containing a carbonating gas in selective communication with the water container via a connection; and means for selectively carbonating water in the water container, via the connection to the cylinder containing the carbonating gas, to dispense carbonated water through the water dispenser, wherein the water container is provided with a safety valve to prevent excess pressure and the safety valve operates on an electrical switch to interrupt, at a predetermined carbonation pressure, the connection between the cylinder and the water container, and wherein the switch activates an indicator advising the user that the water is carbonated and ready to be drawn off.

12. The refrigerator of claim 11, wherein an indicator lamp is provided to signify when the cylinder is empty.

* * * * *